US007413632B2

(12) United States Patent
Kyytsönen et al.

(10) Patent No.: US 7,413,632 B2
(45) Date of Patent: Aug. 19, 2008

(54) METHOD FOR CALENDERING A FIBROUS WEB AND A CALENDER

(75) Inventors: Markku Kyytsönen, Numminen (FI); Pekka Linnonmaa, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 368 days.

(21) Appl. No.: 10/541,165

(22) PCT Filed: Dec. 16, 2003

(86) PCT No.: PCT/FI03/00961

§ 371 (c)(1),
(2), (4) Date: Jun. 30, 2005

(87) PCT Pub. No.: WO2004/061221

PCT Pub. Date: Jul. 22, 2004

(65) Prior Publication Data

US 2006/0042479 A1 Mar. 2, 2006

(30) Foreign Application Priority Data

Jan. 2, 2003 (FI) ..... 20030003

(51) Int. Cl.
*D21F 3/00* (2006.01)

(52) U.S. Cl. ..... 162/358.3; 100/161; 100/47; 100/331; 100/167

(58) Field of Classification Search ..... 162/358.3; 100/331, 162 B, 16, 47, 167, 172
See application file for complete search history.

(56) References Cited

U.S. PATENT DOCUMENTS 4,497,246 A 2/1985 Pav et al.
5,669,295 A 9/1997 Kayser et al.
5,673,617 A 10/1997 Linder
6,248,215 B1 6/2001 Cramer et al.

FOREIGN PATENT DOCUMENTS

EP 0 890 676 A1 1/1999
FI 69150 2/1996
FI 102552 B 12/1998

(Continued)

OTHER PUBLICATIONS

Search Report issued in Finnish Application No. 20030003.

(Continued)

*Primary Examiner*—Mark Halpern
(74) *Attorney, Agent, or Firm*—Stiennon & Stiennon

(57) ABSTRACT

A calender includes at least two roll stacks which each have at least three rolls, and in each of which the web path of a fibrous web meanders between each roll pair of the stack. In order to produce a selectable fibrous web grade, the web is passed between each roll pair of each stack, so that at least one roll pair in at least one stack is in nip contact to form a nip that calenders the web. The web runs between each roll pair of each roll stack and, in order to produce a selectable fibrous web grade, a selectable number of rolls is in nip contact with each other in each stack to form at least one nip that calenders the fibrous web.

18 Claims, 2 Drawing Sheets

FOREIGN PATENT DOCUMENTS

| | | | |
|---|---|---|---|
| FI | 00732447 | | 12/1998 |
| WO | WO 01/23666 | A2 | 4/2001 |
| WO | WO 01/63047 | A1 | 8/2001 |
| WO | WO 2004/061221 | A1 | 7/2004 |

OTHER PUBLICATIONS

International Search Report issued in PCT/FI03/00961.

International Preliminary Examination Report issued in PCT/FI03/00961.

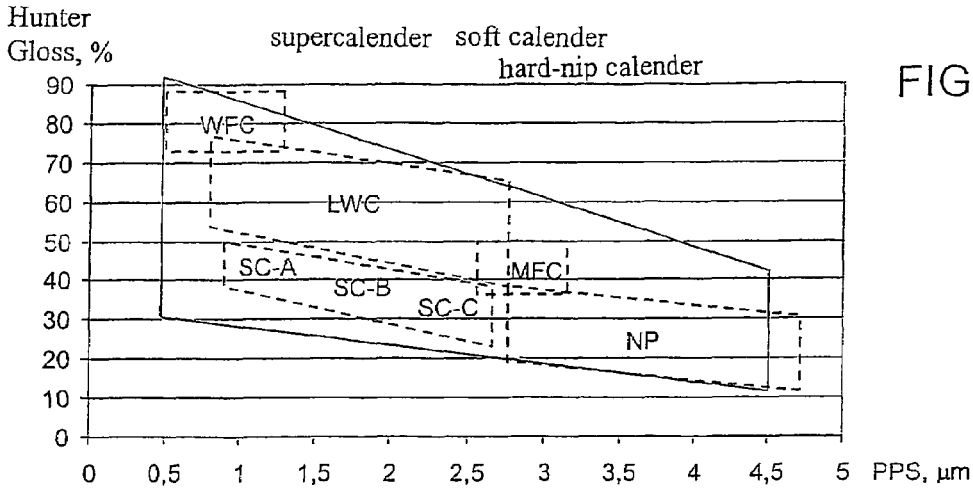
FIG.2
WFC (Woodfree Coated) - coated, supercalendered fine paper
LWC (Light Weight Coated) - coated, supercalendered paper
MFC (Machine Finished Coated) - coated, machine i.e. hard-nip calendered fine paper
SC (Supercalendered) - uncoated, supercalendered paper
NP (Newsprint) - newsprint
FIG. 1
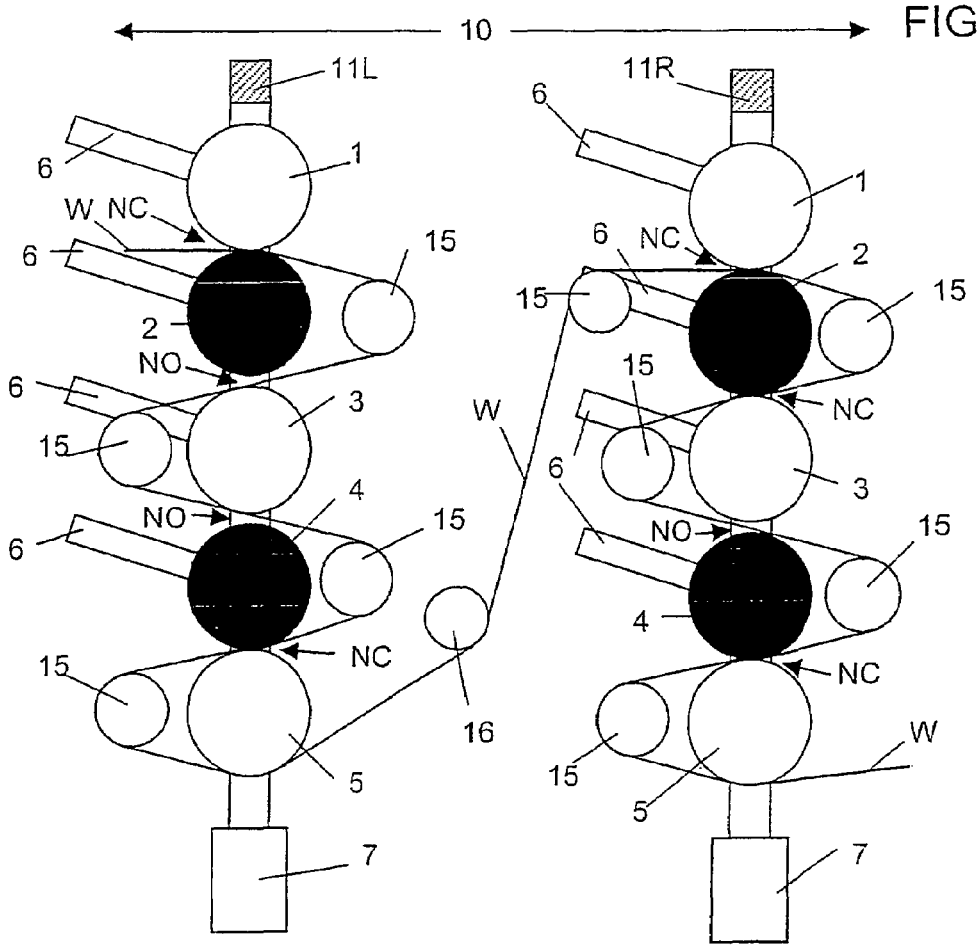

METHOD FOR CALENDERING A FIBROUS WEB AND A CALENDER

CROSS REFERENCES TO RELATED APPLICATIONS

This application is a U.S. national stage application of International App. No. PCT/FI2003/000961, filed Dec. 16, 2003, the disclosure of which is incorporated by reference herein, and claims priority on Finnish App. No. 20030003, Filed Jan. 2, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to paper, pulp, board or other similar fibrous web machines. More specifically, the present invention relates to calenders of fibrous web machines and, in particular, the present invention relates to a method for calendering a fibrous web in a calender which includes at least two roll stacks which each have at least three rolls, and in which calender the fibrous web is passed to run between each roll pair of each roll stack. The invention also relates to a calender which includes at least two roll stacks which each have at least three rolls, and in which calender a fibrous web has been passed to run between each roll pair of each roll stack.

Calendering is a method by means of which attempts are generally made to improve the properties of a web-like material, such as a paper web, in particular, its thickness profile, smoothness, gloss, surface porosity and transparence. In the calendering process, a paper web is passed into a nip formed between rolls pressed against each other, in which nip the paper web is deformed due to the effect of temperature, moisture and nip pressure, whereby the physical properties of the paper web can be affected by regulating the above-mentioned parameters and the time of action. The good physical properties achieved by calendering result in improved print quality, thus giving a competitive advantage to the paper manufacturer.

Up to the mid 1990s, calenders comprised three main categories, which are typically single- or double-nip hard-nip calenders and soft calenders as well as multi-nip supercalenders. All these calender types have their advantages and disadvantages.

Shoe or so-called long-nip calendering has been found to be generally good for producing low-gloss paper grades, i.e. grades having a Hunter gloss % below 40. When a higher gloss is required, the nip pressure is, however, not sufficient to produce gloss. With continuously increasing running speeds, calendering is becoming a bottleneck in the papermaking process and adequate quality is not achieved by means of today's hard-nip calenders. The drawbacks of today's papermaking process also include the fact that the loss of bulk increases when gloss is improved and that to achieve adequate quality it is necessary to employ abundantly coated webs and/or use off-line calendering, in particular soft calendering and/or multi-nip calendering, whose known application is supercalendering. The direction in the processing of the fibrous web and thus also in calendering is, however, towards on-line arrangements to an ever-increasing degree, also when the intention is to produce higher-quality printing paper grades, such as SC and glossy coated papers. FIG. 2 illustrates with a broken line currently available different paper grades, which include, among other things, NP (NewsPrint) newsprint paper grades,
SC (SuperCalendered) paper grades,
MFC (Machine Finished Coated) fine paper grades,
LWC (Light Weight Coated) paper grades, and
WFC (WoodFree Coated) fine paper grades, and today's calenders, which include a hard-nip i.e. machine calender,
a soft calender, and
a supercalender for producing different paper grades. It can also be seen from FIG. 2 that a multi-nip supercalender is remaining as the only alternative when the aim is to manufacture high-quality, i.e. high-gloss and smooth, WFC, LWC and SC paper grades.

The good characteristics of the calendering technique common today are beginning to reach their physical limits and the surface properties of the fibrous web cannot be much improved any more without a risk of the surface being scratched. When running speeds simultaneously increase to be as high as 1600 m/min or more, a drawback is the shortening time of action of calendering, which leads to considerable capacity problems when producing high-quality paper grades, so that even three supercalenders are not necessarily sufficient to produce high quality at high speeds, but even a fourth supercalender is needed, which is expensive both as an investment and in respect of operation.

Because of the development of the soft calender technology, polymer-coated rolls can be used in the calender today. A problem associated with this is, however, that if more than three rolls in the supercalender are provided with an elastic polymer coating, the quality of the fibrous web begins to deteriorate. To meet increasing quality requirements, three new calender types have been developed, which are the Opti-Load® calender developed by Metso Paper, Inc., provided with a single roll stack and typically including 6-12 rolls and having as a special feature the possibility of affecting the linear loads of individual nips and providing the roll stack with a nip load even inversely increasing with respect to the force of gravity; the Janus® calender developed by Voith-Sulzer, provided with two roll stacks and typically including 6-10 rolls; and the Prosoft® calender developed by Küsters-Beloit, provided two roll stacks and typically including 6-14 rolls.

These new type of multi-nip calenders, which can be used both as on-line and off-line calenders, are standard types in today's calendering technique and they are based on enhanced utilization of an elastic roll coating, but they differ substantially from one another in respect of attainable calendering results.

SUMMARY OF THE INVENTION

One object of the present invention is to reduce the weaknesses, drawbacks and problems associated with the known calendering technique and provide a novel calender which makes it possible to produce a fibrous web within a broader range of gloss and smoothness without a need for threading of the fibrous web and/or for shutdown of the fibrous web machine, i.e. to make it possible to change the grade of the fibrous web produced in on-line operation.

This object is achieved by means of the method and the calender of the invention mentioned at the beginning, which method is generally characterized in that in order to produce a selectable fibrous web grade, at least one roll pair in at least one roll stack is arranged to be in nip contact to form a nip that calenders a fibrous web.

In accordance with an advantageous embodiment of the method in accordance with the invention, at least one roll pair in each roll stack is arranged to be in nip contact to form in each roll stack at least one nip that calenders a fibrous web.

By means of the method in accordance with the invention, by increasing the number of closed i.e. calendering nips in the calender it is possible to produce higher-quality paper grades, such as SC-A, SC-B, LWC and WFC grades, and by decreasing the number of closed i.e. calendering nips in the calender it is possible to produce lower-quality paper grades, such as NP, SC-C and/or MFC grades.

The aim of the invention is also achieved by means of the calender mentioned at the beginning, which calender is generally characterized in that in order to produce a selectable fibrous web grade, at least one roll pair in at least one roll stack has been arranged to be in nip contact to form at least one nip that calenders a fibrous web.

An advantageous embodiment of the calender in accordance with the invention is characterized in that in order to produce a selectable fibrous web grade, at least one roll pair is in nip contact in each roll stack, whereby at least one nip that calenders a fibrous web is formed in each roll stack.

The invention can be employed to produce fibrous webs of different grades and to change the grade of the fibrous web during running in any combination of rolls. Advantageous calenders for applying the invention are, among other things, various multi-roll-stack calenders, such as, for example, OptiLoad®, Janus® and Prosoft® calenders. In that connection, it is to be recommended that the roll combination in two successive roll stacks of the calender is, for example, 2×3, 2×5, 2×7, 3+5, 5+5, 5+7.

As all rolls in the calender in accordance with the invention are movable with respect to each other, a fibrous web can be calendered on the calender while all nips are operating, in which connection all roll gaps in each roll stack of the calender are closed and form a closed nip, or while one/some of the nips is/are operating, in which connection at least one roll gap in at least one roll stack is open, i.e. a nip that does not calender the fibrous web. In that connection, different paper grades, such as NP, SC, MFC, LWC and WFC grades can be produced by regulating the number and/or nip load of closed i.e. calendering nips. Particularly advantageously, operation with one/some of the nips is suitable for the production of lower-quality paper grades, such as NP, SC-C and MFC grades, and operation with all nips is suitable for the production of high-quality paper grades, such as SC-A, SC-B, LWC and WFC grades.

In accordance with the invention, for moving rolls at least one roll stack of the calender includes power means arranged between carrier arms, support arms or bearing housings of roll pairs formed by rolls placed one upon the other in order to adjust nip load and/or to form an open nip and/or to form a closed nip between a roll pair by moving the rolls of the roll pair in a direction substantially away from each other or towards each other.

With respect to the advantages of the invention it may be mentioned that calendering capacity can be improved by the possibility of creating an on-line process line using a single calender arrangement for producing different grades, as an example of this can be mentioned a process line that makes it possible to produce fibrous webs of different grades, such as a paper web whose grade can be selected between the grades newsprint . . . SC-A. An advantage is also that the fibrous web production line need not be stopped for the duration of maintenance of the calender. In that case, in on-line operation it is possible to replace, for example, a soft roll with a thermo roll or vice versa, thus achieving a different calender in respect of its production characteristics.

In the following, the invention will be described by way of example by means of one advantageous embodiment of the invention, which is accomplished in Metso Paper, Inc.'s OptiLoad® calender, with reference to the appended drawings.

BRIEF DESCRIPTION OF THE DRAWINGS

FIG. 1 schematically illustrates a calender comprising two roll stacks, such as, for example, an OptiLoad®, Janus® or Prosoft® supercalender having two roll stacks, to make use of the present invention.

FIG. 2 illustrates paper grades attainable by means of ordinary known calendering techniques and paper grades attainable by the method and the calender in accordance with the invention in a system of Hunter gloss/smoothness coordinates.

DESCRIPTION OF THE PREFERRED EMBODIMENTS

Figure 3:
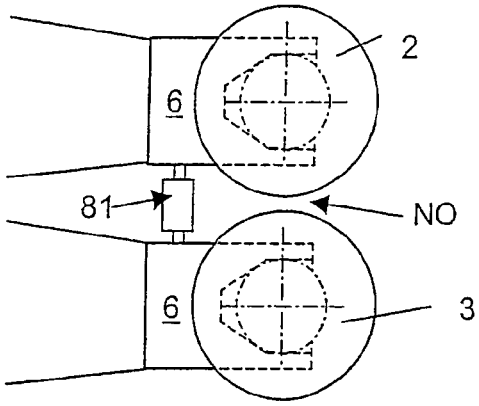
FIG. 3 shows one embodiment for moving the rolls of one roll pair in the calender with respect to each other.

FIG. 1 is a schematic view of a supercalender 10 provided with two roll stacks. Hereafter the supercalender provided with two roll stacks is referred to by the definition calender 10 for the sake of simplicity. The calender 10 shown in FIG. 1 includes two roll stacks 11L, 11R. In both roll bodies of the calender, a top roll 1, a bottom roll 5 and a center roll 3 are soft rolls having an elastic shell and a thermo roll 2, 4 having a hard-surface shell is arranged between the top roll 1 and the center roll 3 as well as between the bottom roll 5 and the center roll 3.

In the calender 10 of FIG. 1, a fibrous web W runs in both roll stacks 11L, 11R, between which the travel of the web is guided by a guide roll 16, meandering between each roll pair 1, 2; 2, 3; 3, 4; 4, 5 around spreader rolls 15 of the web. In both roll stacks 11L, 11R there are four roll gaps NC, NO, one between each roll pair 1, 2; 2, 3; 3, 4; 4, 5. In the embodiment of FIG. 1, a roll pair is formed of an elastic roll and a thermo roll. When the rolls of a roll pair are in shell contact with each other, a nip NC that calenders the web is formed between the rolls, and when the rolls of a roll pair are out of shell contact with each other, a roll gap NO that does not calender the web W is formed.

In accordance with the basic idea of the invention, to produce a selectable fibrous web grade, at least one roll pair in at least one roll stack is arranged to be in nip contact to form a nip that calenders the fibrous web. In other words, in order to produce a selectable fibrous web grade, in the calender in accordance with the invention there is in at least one roll stack 11 at least one roll pair 1, 2 in nip i.e. shell contact, whereby at least one nip NC that calenders the fibrous web is formed.

To form two nips NC that calender the web W, in the embodiment of FIG. 1, the top roll 1 and the upper thermo roll 2 as well as the bottom roll 5 and the lower thermo roll 4 are arranged to be in nip contact in the left-hand roll stack 11L of the calender 10 by moving the rolls in the vertical direction, i.e. more generally in the direction of the roll stack. To form three nips NC that calender the web W, in the embodiment of FIG. 1, the top roll 1 and the upper thermo roll 2, the upper thermo roll 2 and the center roll 3, as well as the bottom roll 5 and the lower thermo roll 4 are arranged to be in nip contact in the right-hand roll stack 11R by moving the rolls. In the calender 10 of the embodiment of FIG. 1, the rolls 1-4 in both roll stacks 11L, 11R are movable by means of loading or carrier arms 6. In addition, by means of the carrier arms 6 it is possible to adjust the magnitude of the compression or loading force applied on the fibrous web by the nip NC between the rolls which are in shell or nip contact. In the embodiment of FIG. 1, in both roll stacks 11L, 11R of the calender 10, the bottom roll 5 is loaded by a hydraulic cylinder 7 which is located underneath the bottom roll 5 and which advantageously acts in the same manner as the loading or carrier arms 6 on the non-rotating shaft of the roll or on the bearing housings of the roll shell journalled to be rotatable on the shaft.

Reference is made to FIG. 3 showing one embodiment for moving the rolls of one roll pair of the calender with respect to each other, for example, in the direction of the roll stack. In the embodiment of FIG. 3, which is particularly suitable for Metso Paper, Inc.'s OptiLoad® calender, a power member 81, which is advantageously a hydraulic or pneumatic cylinder or a power screw, is disposed between the loading, support or relief arms 6 of the rolls, which arms turn in a lever-like manner at one end thereof. When the length of the power member 81 is increased, the loading, support or relief arms 6 turn in a lever-like manner away from each other, whereby the nip load between the rolls of the roll pair 2, 3 is relieved or the rolls come out of shell contact and form an open nip NO of FIG. 3 that does not calender the fibrous web W. When the length of the power means 81 is shortened, the loading, support or relief arms 6 turn in a lever-like manner towards each other, whereby the nip load between the rolls of the roll pair 2, 3 increases and the nip NC that calenders the fibrous web W is closed.

Figure 4:
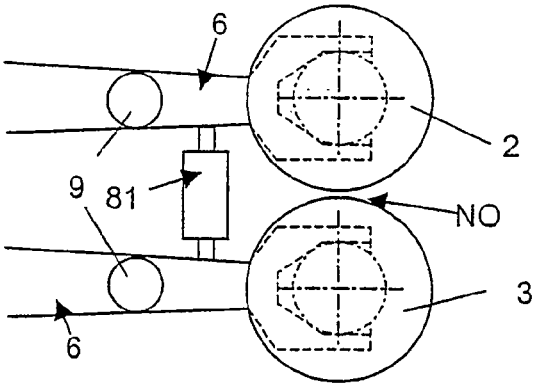
FIG. 4 shows a second embodiment for moving the rolls of one roll pair in the calender with respect to each other.

Reference is made to FIG. 4 showing a second embodiment for moving the rolls of one roll pair of the calender with respect to each other, for example, in the direction of the roll stack. In the embodiment of FIG. 4, which embodiment like the embodiment of FIG. 3 is suitable in particular for Metso Paper Inc.'s OptiLoad® calender, a power means 81, which is advantageously a hydraulic or pneumatic cylinder or a power screw, is disposed between the loading, support or relief arms 6 of the rolls, which arms turn in a lever-like manner at one end thereof. The embodiment of FIG. 4 differs from the embodiment of FIG. 3 in that the loading, support or relief arms 6 are connected by means of an articulated joint 9 to form two parts. In this embodiment of FIG. 4, the power means is arranged on a second part of the loading, support or relief arms 6 on the side of the roll 2, so that a first part of the loading, support or relief arms 6 can be kept unmovable and non-turning about its fulcrum point in a lever-like manner, which substantially facilitates the locking of the loading, support or relief arms 6 in a desired orientation. When the length of the power means 81 is increased, the second parts of the loading, support or relief arms 6 on the side of the rolls 2, 3 turn in a lever-like manner away from each other, whereby the nip load between the rolls of the roll pair 2, 3 is relieved or the rolls come out of shell contact and form an open nip NO of FIG. 4 that does not calender the fibrous web W. When the length of the power means 81 is shortened, the second parts of the loading, support or relief arms 6 on the side of the rolls 2, 3 turn in a lever-like manner towards each other, whereby the nip load between the rolls of the roll pair 2, 3 increases and the nip NC that calenders the fibrous web W is closed.

Figure 5:
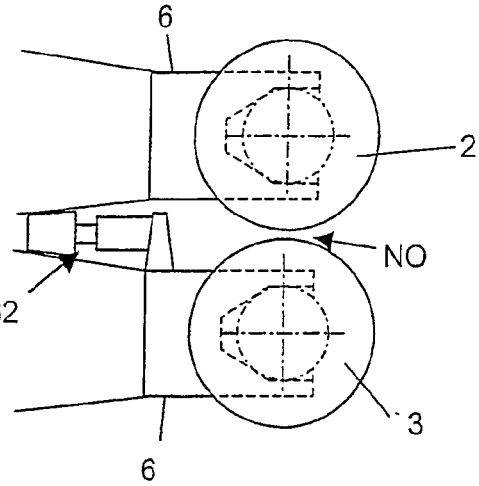
FIG. 5 shows a third embodiment for moving the rolls of one roll pair in the calender with respect to each other.

Reference is made to FIG. 5 showing one embodiment for moving the rolls of one roll pair of the calender with respect to each other. The embodiment of FIG. 5 substantially corresponds in operation to the embodiment of FIG. 3 and is thus suitable for use in particular in Metso Paper, Inc.'s OptiLoad® calenders. In this embodiment of FIG. 5, a power means 82 includes a wedge means that is movable by means of a hydraulic, pneumatic or a similar actuator to and fro, advantageously in a direction transverse to the center line passing through the center axes of the rolls of the roll pair 2, 3. In the embodiment of FIG. 5, the wedge means of the power means 82 acts between the loading, support or relief arms 6 of the rolls such that when the wedge means is moved by means of the power means away from the roll pair 2, 3, the nip load between the rolls is relieved or the rolls come out of shell contact and form an open nip NO of FIG. 5 that does not calender the fibrous web W, and such that when the wedge means is moved towards the roll pair 2, 3, the nip load between the rolls increases and the nip NC that calenders the fibrous web W is closed.

In connection with the embodiment of FIG. 5 it must be noted that the wedge means can also be arranged to act between non-rotating shafts of the roll pair 2, 3 or between bearing housings of the rolls joumalled to be rotatable, so that the embodiment is suitable for use in calenders in which the rolls 1-5 are not provided with loading, support or relief arms 6, such as in Janus® and Prosoft® calenders.

Figure 6:
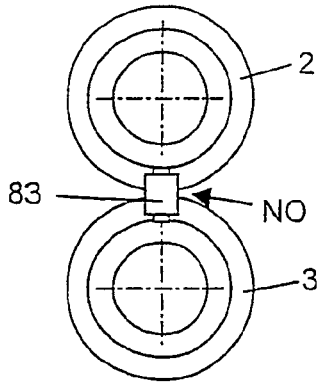
FIG. 6 shows a fourth embodiment for moving the rolls of one roll pair in the calender with respect to each other.

Reference is made to FIG. 6 showing one embodiment for moving the rolls of one roll pair of the calender with respect to each other. In the embodiment of FIG. 6, which embodiment is suitable for use in calenders whose rolls 1-5 are not provided with loading, support or relief arms 6, a power means 83 is arranged between the non-rotating shafts of the roll pair 2, 3 or between the bearing housings of the rolls joumalled to be rotatable, which power means 83 is advantageously a hydraulic or pneumatic cylinder or a power screw. When the length of this kind of power means 83 is increased, the nip load between the rolls of the roll pair 2, 3 is relieved or the rolls come out of shell contact and form an open nip NO of FIG. 6 that does not calender the fibrous web W. When the length of this kind of power means 83 is shortened, the nip load between the rolls of the roll pair 2, 3 increases and the nip NC that calenders the fibrous web W is closed.

In connection with the invention it must be emphasized that the number of the rolls in the roll stack 11L, 11R is not essential to the present invention. In accordance with the invention it is advantageous, however, that the roll combination of two successive roll stacks is selected from the group which includes 2×3, 2×5, 2×7, 3+5, 5+5 and 5+7 rolls. When the number of rolls is other than the five rolls shown in FIG. 1, i.e. n rolls, in the roll stack there are correspondingly more or fewer roll gaps than the four roll gaps of FIG. 1, i.e. n-1 roll gaps. Said roll combination is provided, for example, by two successive roll stacks of Metso Paper, Inc.'s OptiLoad® supercalender, by two successive roll stacks of Voith-Sulzer's Janus® supercalender or by two successive roll stacks of Küsters-Beloit's Prosoft® supercalender.

When the purpose of the calender in accordance with the invention is to produce smoother and glossier paper qualities of different paper grades, such as WFC, LWC and SC paper grades, at least one roll pair 1, 2; 2, 3; 3, 4; 4, 5 is arranged to be in nip contact in each roll stack 11L, 11R and thus to form at least one nip NC calendering the fibrous web W in each roll stack.

By means of the calender in accordance with the invention it is thus possible to calender a fibrous web while all nips are operating or while one/some of the nips is/are operating. When all nips are operating, all roll gaps in each roll stack 11L, 11R of the calender 10 are closed forming closed nips NC that calender the fibrous web W. A roll gap is closed to form a web-calendering nip NC by moving the rolls of a roll pair 1, 2; 2, 3; 3, 4; 4, 5 defining the roll gap into shell i.e. nip contact with each other, for example, in the direction of the roll stack. Operation with one/some of the nips operating differs from operation with all nips operating in that at least one roll gap in at least one roll stack 11L, 11R of the calender 10 is an open roll gap or nip NO, in which the fibrous web is not calendered.

Reference is made to FIG. 2, which shows with a broken line the paper grade ranges which can be produced on known calenders and with an unbroken line the range which can be produced on the calender 10 in accordance with the present invention. It is characteristic of the prior-art calendering technique that, as the starting point, a different calender type is intended for different paper grades. In accordance with the present invention, many different paper grades, including NP, SC, MFC, LWC and MFC grades, can be produced by means of one and the same calender of the invention, the type of said calender being a supercalender provided with at least two roll stacks, by regulating the number of the calendering nips NC, i.e. operation with all or one/some of the nips, and the nip load of the calendering nips NC. In that connection, operation with one/some of the nips is most suitable for the production of lower-quality paper grades, such as NP, SC-C and MFC grades, and operation with all nips is favorably suitable for the production of high-quality paper grades, such as SC-A, SC-B, LWC and WFC grades.

In summary of the invention it may thus be stated that, at the same time as the present invention allows complete on-line or off-line operation, it is possible merely by increasing the number of calendering nips NC in the calender 10 to produce higher-quality paper grades, and by decreasing the number of calendering nips NC in the calender 10 to produce lower-quality paper grades.

Above, the invention has been described only by way of example by means of one of its advantageous embodiments. By this it is, however, not desired to limit the invention to such a single exemplifying embodiment and, as is clear to a person skilled in the art, many alternative arrangements and variations are feasible within the scope of protection of the new and inventive basic idea defined in the appended claims.

Thus, it must be emphasized that the number of the roll stacks 11L, 11R of the calender 10 may differ from the two roll stacks shown in FIG. 1 and that the roll stack can in itself be formed of a roll order other than the roll order shown in FIG. 1, in which there are alternately soft rolls and thermo rolls, so that to form a roll pair, the roll stack 11L, 11R may comprise, for example two opposing thermo rolls, in which connection the roll pair can form a hard nip and the roll stack can serve as a hard-nip i.e. machine calender, or two opposing soft rolls, in which connection the roll pair forms therebetween a reversing nip that does not calender the web W to calender the web on two sides in one roll stack 11L, 11R.

The invention claimed is:

1. A method for calendering a fibrous web in a calender which includes at least a first roll stack having three or five rolls, forming two or four pairs of rolls wherein the rolls of said roll pairs are movable with respect to each other in a direction defined by the first roll stack so as to form an open or closed nip, and a second roll stack having at least five rolls forming at least four roll pairs wherein the rolls of said roll pairs are movable with respect to each other in a direction defined by the second roll stack so as to form an open or closed nip, the method comprising the steps of:

passing a fibrous web between each pair of rolls in the first stack and each pair of rolls in the second stack to form a threaded path;

moving at least one pair of rolls from said first stack or said second stack to form at least one nip therebetween;

producing a first grade of paper of selected PPS and selected Hunter Gloss % by calendering the web in the calender along the threaded path, followed by producing a second grade of paper of second selected PPS and second selected Hunter Gloss % along the threaded path by increasing or decreasing the number of nips formed by the calender.

2. The method of claim 1, wherein at least one roll pair in each roll stack is arranged to be in nip contact to form in each roll stack at least one nip that calenders the fibrous web.

3. The method of claim 1 wherein the paper web continuously passes along the threaded path while the first paper grade is changed to the second paper grade.

4. The method of claim 1 wherein the rolls are arranged by increasing or decreasing the number of nips formed by the calender to produce a web with a Hunter Gloss % of less than 50% and a PPS of greater than 2 micrometers, followed by or preceded by production of paper grades with a Hunter Gloss % of greater than 50% and a PPS of less than 2 micrometers.

5. The method of claim 1, wherein over time the rolls are arranged to produce paper webs within a range of a Hunter Gloss % from 30% to 91% and a PPS of 0.5 micrometers to 4.5.

6. The method of claim 1, wherein the pairs of rolls of the first stack and the second stack are supported on support or relief arms which are movable with respect to each other; and further comprising the step of increasing or decreasing the length of a hydraulic or pneumatic cylinder or a power screw positioned between the arms to open or close the pairs of rolls.

7. The method of claim 1, wherein the pairs of rolls of the first stack and the second stack are mounted to support or relief arms; and further comprising the steps of holding the arms fixed and moving the pairs of rolls with respect to each other on articulated joints between the arms and said rolls, by increasing or decreasing the length of a hydraulic or pneumatic cylinder or a power screw mounted between adjacent ones of said joints.

8. The method of claim 1, wherein the rolls of the pairs of rolls of the first stack and the second stack are mounted to support or relief arms; and further comprising the step of opening or closing the pairs of rolls by moving a wedge between the arms of the roll pairs by increasing or decreasing the length of a hydraulic or pneumatic cylinder or a power screw mounted between one of said arms and the wedge.

9. The method of claim 1, wherein the rolls of the pairs of rolls of the first stack and the second stack have bearing housings to which the rolls are journalled to be rotated but are not provided with support or relief arms; and further comprising the step of increasing or decreasing the length of a hydraulic or pneumatic cylinder or a power screw positioned between the bearing housings to open or close the pairs of rolls.

10. A method for calendering a fibrous web in a calender which includes at least two roll stacks, including a first roll stack and a second roll stack, said first stack having three or five rolls, forming two or four pairs of rolls wherein the rolls of said roll pairs are movable with respect to each other, in a direction defined by the first roll stack so as to form an open or closed nip, and said second roll stack having at least five or seven rolls forming four or six roll pairs, wherein the rolls of said roll pairs are movable with respect to each other, in a direction defined by the second roll stack so as to form an open or closed nip, and in which calender the web is passed to run between each roll pair of each roll stack, the method comprising the steps of:

disposing the rolls of each of the at least two roll stacks such that at least one roll pair is in nip contact to form a first nip;

causing the web to pass through said first nip to calender the web; and adjusting the rolls of the at least two roll stacks to increase the number of nips through which the web passes to form a higher-quality paper grade, or to decrease the number of nips through which the web passes to form a lower-quality paper grade.

11. The method of claim 10, wherein at least one roll pair in each roll stack is arranged to be in nip contact to form in each roll stack at least one nip that calenders the fibrous web.

12. The method of claim 10, wherein the paper web continuously passes between each roll pair while the rolls are adjusted to form a higher-quality paper grade, or to form a lower-quality paper grade.

13. The method of claim 10, wherein the rolls are arranged to produce a web with a Hunter Gloss % of less than 50% and a PPS of greater than 2 micrometers, followed by or preceded by the roll pairs being arranged for a production of paper grades with a Hunter Gloss % of greater than 50% and a PPS of less than 2 micrometers.

14. The method of claim 10, wherein over time the rolls are arranged to produce paper webs within a range of a Hunter Gloss % from 30% to 91% and a PPS of 0.5 micrometers to 4.5.

15. The method of claim 10, wherein the pairs of rolls of the first stack and the second stack are supported on support or relief arms which are movable with respect to each other; and further comprising the step of increasing or decreasing the length of a hydraulic or pneumatic cylinder or a power screw positioned between the arms to open or close the pairs of rolls.

16. The method of claim 10, wherein the pairs of rolls of the first stack and the second stack are mounted to support or relief arms; and further comprising the steps of holding the arms fixed and moving the pairs of rolls with respect to each other on articulated joints between the arms and said rolls, by increasing or decreasing the length of a hydraulic or pneumatic cylinder or a power screw mounted between adjacent ones of said joints.

17. The method of claim 10, wherein the rolls of the pairs of rolls of the first stack and the second stack are mounted to support or relief arms; and further comprising the step of opening or closing the pairs of rolls by moving a wedge between the arms of the roll pairs by increasing or decreasing the length of a hydraulic or pneumatic cylinder or a power screw mounted between one of said arms and the wedge.

18. The method of claim 10, wherein the rolls of the pairs of rolls of the first stack and the second stack have bearing housings to which the rolls are journalled to be rotated but are not provided with support or relief arms; and further comprising the step of increasing or decreasing the length of a hydraulic or pneumatic cylinder or a power screw positioned between the bearing housings to open or close the pairs of rolls.

* * * * *